US007997937B2

(12) United States Patent
Kondo

(10) Patent No.: US 7,997,937 B2
(45) Date of Patent: Aug. 16, 2011

(54) MULTIPOLAR CONNECTOR

(75) Inventor: Hayato Kondo, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 12/591,282

(22) Filed: Nov. 16, 2009

(65) Prior Publication Data

US 2010/0167568 A1 Jul. 1, 2010

(30) Foreign Application Priority Data

Dec. 25, 2008 (JP) ..... 2008-331062

(51) Int. Cl.
*H01R 24/00* (2011.01)

(52) U.S. Cl. ..... 439/660; 439/607.4

(58) Field of Classification Search ..... 439/600, 439/941, 924.1, 608, 607.07, 607.06, 607.35–607.4, 439/665, 610, 660
See application file for complete search history.

(56) References Cited

U.S. PATENT DOCUMENTS

| | | | | |
|---|---|---|---|---|
| 4,653,825 | A * | 3/1987 | Olsson | 439/295 |
| 4,981,447 | A * | 1/1991 | Ichitsubo | 439/607.23 |
| 5,518,421 | A * | 5/1996 | Davis | 439/607.5 |
| 5,641,308 | A * | 6/1997 | Bixler et al. | 439/660 |
| 6,036,549 | A * | 3/2000 | Wulff | 439/660 |
| 6,280,209 | B1 * | 8/2001 | Bassler et al. | 439/101 |
| 6,315,608 | B1 | 11/2001 | Lopata | |
| 6,379,184 | B1 * | 4/2002 | Bassler et al. | 439/607.27 |
| 6,383,023 | B1 | 5/2002 | Chang | |
| 6,540,559 | B1 * | 4/2003 | Kemmick et al. | 439/607.05 |
| 6,863,549 | B2 * | 3/2005 | Brunker et al. | 439/108 |
| 7,303,410 | B2 * | 12/2007 | Saito | 439/108 |
| 7,371,116 | B2 * | 5/2008 | Chiang | 439/607.34 |
| 7,670,156 | B2 * | 3/2010 | Chen | 439/108 |
| 2005/0136709 | A1 * | 6/2005 | Link | 439/79 |
| 2007/0077818 | A1 | 4/2007 | Iwakawa | |
| 2007/0087589 | A1 * | 4/2007 | Riku | 439/69 |
| 2008/0242142 | A1 | 10/2008 | Takeuuchi | |
| 2009/0111320 | A1 * | 4/2009 | Johansson et al. | 439/466 |
| 2010/0022138 | A1 * | 1/2010 | Miyoshi et al. | 439/660 |
| 2010/0087098 | A1 * | 4/2010 | Sloey et al. | 439/660 |

FOREIGN PATENT DOCUMENTS

| | | |
|---|---|---|
| EP | 1 758 209 A2 | 2/2007 |
| JP | 2005-149770 | 6/2005 |

* cited by examiner

*Primary Examiner* — Michael Zarroli
*Assistant Examiner* — Harshad Patel
(74) *Attorney, Agent, or Firm* — Bacon & Thomas, PLLC

(57) ABSTRACT

According to the present invention, a multipolar connector 1 has a housing 2 made of an insulating material, and a plurality of terminals P1 to P6 which are held by the housing 2. The plurality of terminals P1 to P6 include: a terminal pair P3, P4 in which two terminals P3, P4 that are adjacent to each other while disposing a first gap A are paired; and one non-paired terminal P2 or P5 which is adjacent to the terminal pair P3, P4 while disposing a second gap B. The terminal pair P3, P4 is a pair for transmitting differential signals. The first gap A is narrower than the second gap B.

6 Claims, 6 Drawing Sheets

MULTIPOLAR CONNECTOR

TECHNICAL FIELD

The present invention relates to a multipolar connector for efficiently transmitting high-speed differential signals between electronic apparatuses.

BACKGROUND ART

In a multipolar connector for transmitting high-speed differential signals, when differential signal terminals and other terminals (for example, non-paired terminals (i.e., terminals except terminals of a terminal pair) such as a power source terminal and a ground terminal) are arranged at regular pitches, the coupling force between the differential pair cannot be sufficiently ensured, and the transmission mode becomes similar relatively to the single mode. As compared with the differential mode transmission, the single mode transmission is inferior in various characteristics such as the signal speed, the skew, and noises. When the pitches are simply narrowed in order to enhance the coupling force, the impedance is excessively lowered by influence of the other terminals with respect to other impedances to be used together, or a standard value. In a connector portion of a 100-ohm differential impedance system, therefore, the differential mode transmission is hardly realized at the regular pitches.

On the other hand, Patent Literature 1 discloses a terminal structure where differential signal terminals are made different in width or bent, whereby the pitch gap of contact portions of the differential signal terminals which are to be connected to counter terminals is made narrower than that between the contact portions of the differential signal terminals and contact portions of other terminals adjacent to the differential signal terminals.

PRIOR ART LITERATURE

Patent Literature

[Patent Literature 1] Japanese Patent Application Laying-Open No. 2005-149770

DISCLOSURE OF THE INVENTION

Problems to be Solved by the Invention

In the terminal structure disclosed in Patent Literature 1, there is the possibility that the coupling force between the differential pair can be enhanced and the influence of the other terminals can be reduced. However, the differential signal terminals are made different in width or bent, and hence the gap of the differential pair becomes uneven, so that the impedance is discontinuous, thereby causing the possibility that the signal quality is adversely affected. In the case where a housing made of an insulating material, and the terminals are to be integrated with one another by insert molding, there are further problems in that uneven shapes of the terminals causes molds to be hardly produced, and a high accuracy cannot be obtained.

The invention has been conducted in view of above-discussed circumstances. It is an object of the invention to provide a multipolar connector in which, in order to prevent the impedance from being discontinuous, and molds which are used for integrating a housing made of an insulating material with terminals by insert molding, from being hardly produced and being lowered in accuracy, the coupling force between a differential pair can be enhanced, an influence of a non-paired terminal can be reduced, and a signal can be transmitted also in a connector portion in the differential mode, and which has excellent high speed transmission characteristics.

Means for Solving the Problems

In order to solve the problems, the multipolar connector of the invention has the following configuration. The multipolar connector has a housing 2 made of an insulating material, and a plurality of terminals P1 to P6 which are held by the housing 2. The plurality of terminals P1 to P6 include: a terminal pair P3, P4 in which two terminals P3, P4 that are adjacent to each other while disposing a first gap A are paired; and one non-paired terminal P2 or P5 which is adjacent to the terminal pair P3, P4 while disposing a second gap B. The terminal pair P3, P4 is a pair for transmitting differential signals. The first gap A is narrower than the second gap B. In each of the terminals P3, P4 of the terminal pair P3, P4, and the non-paired terminal P2 or P5, a contacting portion 9 which is to be connected to a counter terminal, a terminal portion 11 which is to be connected to a connection object 100, and a supporting portion 10 through which the contacting portion 9 and the terminal portion 11 are coupled to each other are disposed. In the terminals P3, P4 of the terminal pair P3, P4, and the non-paired terminal P2 or P5, respective center lines L2, L3, L4, L5 are linearly extended in directions of inserting and extracting a counter connector in a plan view.

Preferably, the thus configured multipolar connector of the invention is added with a configuration such as: the plurality of terminals P1 to P6 include two or more terminal pairs P1, P2, P3, P4, P5, P6, at least one terminal pair P3, P4 is the pair for transmitting differential signals, a gap between two adjacent terminal pairs P1, P2 and P3, P4, or P3, P4 and P5, P6 is the second gap B, and the plurality of terminals P1 to P6 constitute a plurality of pairs of two terminals; in each of the plurality of terminals P1 to P6, an embedded portion 13 which is embedded into the housing 2 is disposed in a tip end part of the contacting portion 9 while surrounding the tip end part with an insulating material (an dielectric material); in the housing 2, between the contacting portions 9 of the plurality of terminals P1 to P6, partition walls 16 which are projected from contacting faces of the contacting portions 9 are disposed; and the connector further has a metal-made shield case 4 which surrounds a periphery of the housing 2, and the housing 2, the plurality of terminals P2, P3, P4, P5, and the shield case 4 form a coplanar structure.

Effects of the Invention

According to the invention, the gap (the first gap A) between the terminals P3, P4 of the terminal pair P3, P4 is narrowed to enhance the coupling force between the differential pair, and the terminal gap (the second gap B) between the terminal pair P3, P4 and the non-paired terminal P2 or P5 which is adjacent thereto is widened to reduce the influence of the non-paired terminal P2 or P5 on the terminal pair P3, P4, with the result that a signal can be transmitted also in the connector portion in the differential mode. In this case, in the terminals P3, P4 of the terminal pair P3, P4, and the non-paired terminal P2 or P5, the respective center lines L2, L3, L4, L5 are linearly extended in the directions of inserting and extracting the counter connector in a plan view. Therefore, the uniformity of the terminal gap (the first gap A) in the terminal pair P3, P4 can be easily ensured, so that the impedance hardly becomes discontinuous, and the shapes of the terminals P1 to P6 are uniform. In the case where the housing 2 and the terminals P1 to P6 are to be integrated with one another by insert molding, therefore, molds can be easily produced, and a high accuracy can be easily obtained. Consequently, it is possible to provide a multipolar connector in which, in order to prevent the impedance from being discontinuous, and molds which are used for integrating the housing 2 made of an insulating material with the terminals P1 to P6 by insert molding, from being hardly produced and being lowered in accuracy, the coupling force between the differential pair can be enhanced and an influence of the non-paired terminal P2 or P5 can be reduced, and a signal can be transmitted also in the connector portion in the differential mode, and which has excellent high speed transmission characteristics.

In the configuration where the plurality of terminals P1 to P6 include two or more terminal pairs P1, P2, P3, P4, P5, P6, at least one terminal pair P3, P4 is a pair for transmitting differential signals, the gap between two adjacent terminal pairs P1, P2 and P3, P4, or P3, P4 and P5, P6 is the second gap B, and the plurality of terminals P1 to P6 constitute a plurality of pairs of two terminals, even when a ground terminal is not disposed between the pairs, the pairs can cope with a high speed signal. In the configuration where, in each of the plurality of terminals P1 to P6, the embedded portion 13 which is embedded into the housing 2 is disposed in a tip end part of the contacting portion 9 while surrounding the tip end part with an insulating material, or where, in the housing 2, between the contacting portions 9 of the plurality of terminals P1 to P6, the partition walls 16 which are projected from the contacting faces of the contacting portions 9 are disposed, the coupling force between the differential pair is enhanced. In the configuration where the connector further has the metal-made shield case 4 which surrounds the periphery of the housing 2, and the housing 2, the plurality of terminals P2, P3, P4, P5, and the shield case 4 form a coplanar structure, a transmission line which is optimum for transmitting a high speed signal is obtained.

MODE FOR CARRYING OUT THE INVENTION

Hereinafter, an embodiment of the invention will be described with reference to the drawings.

Figure 1:
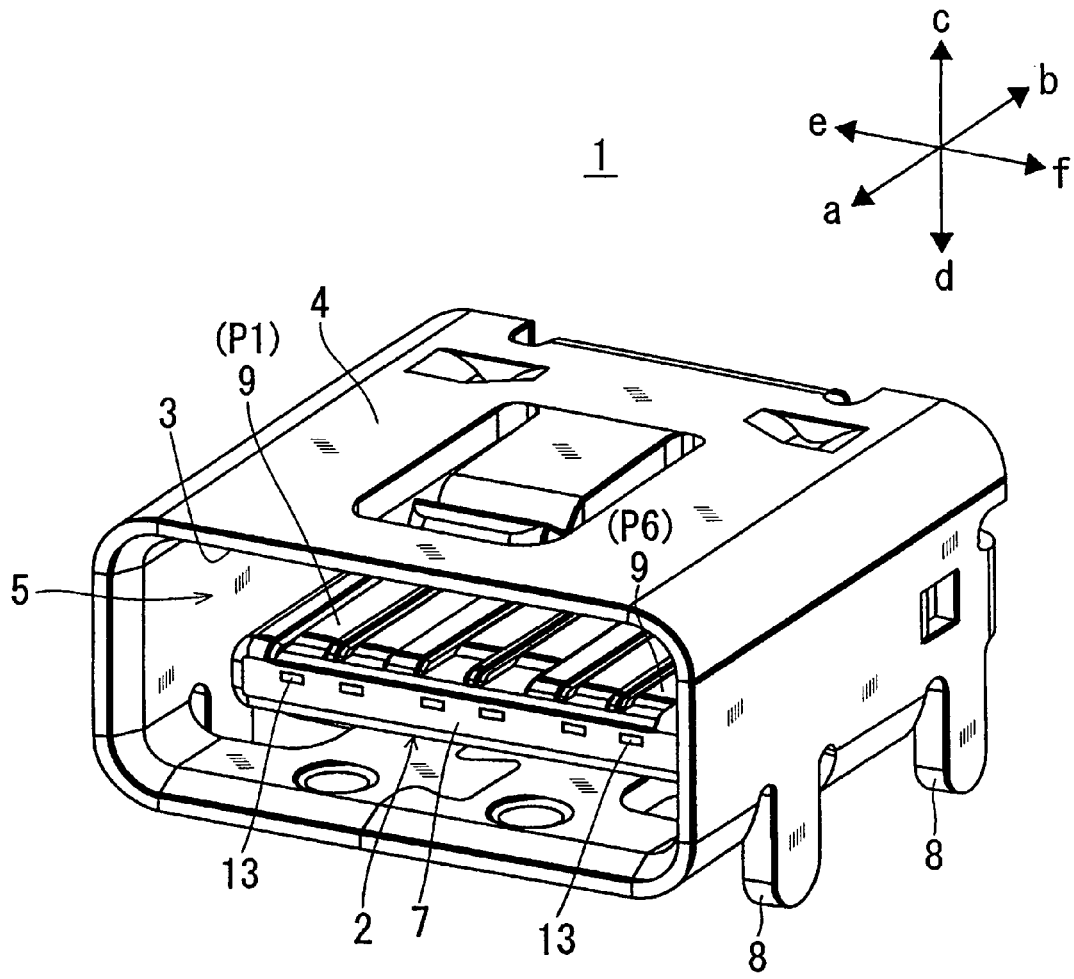
FIG. 1 is an external view of a multipolar connector of an embodiment of the invention, as seen from an obliquely front side.
Figure 2:
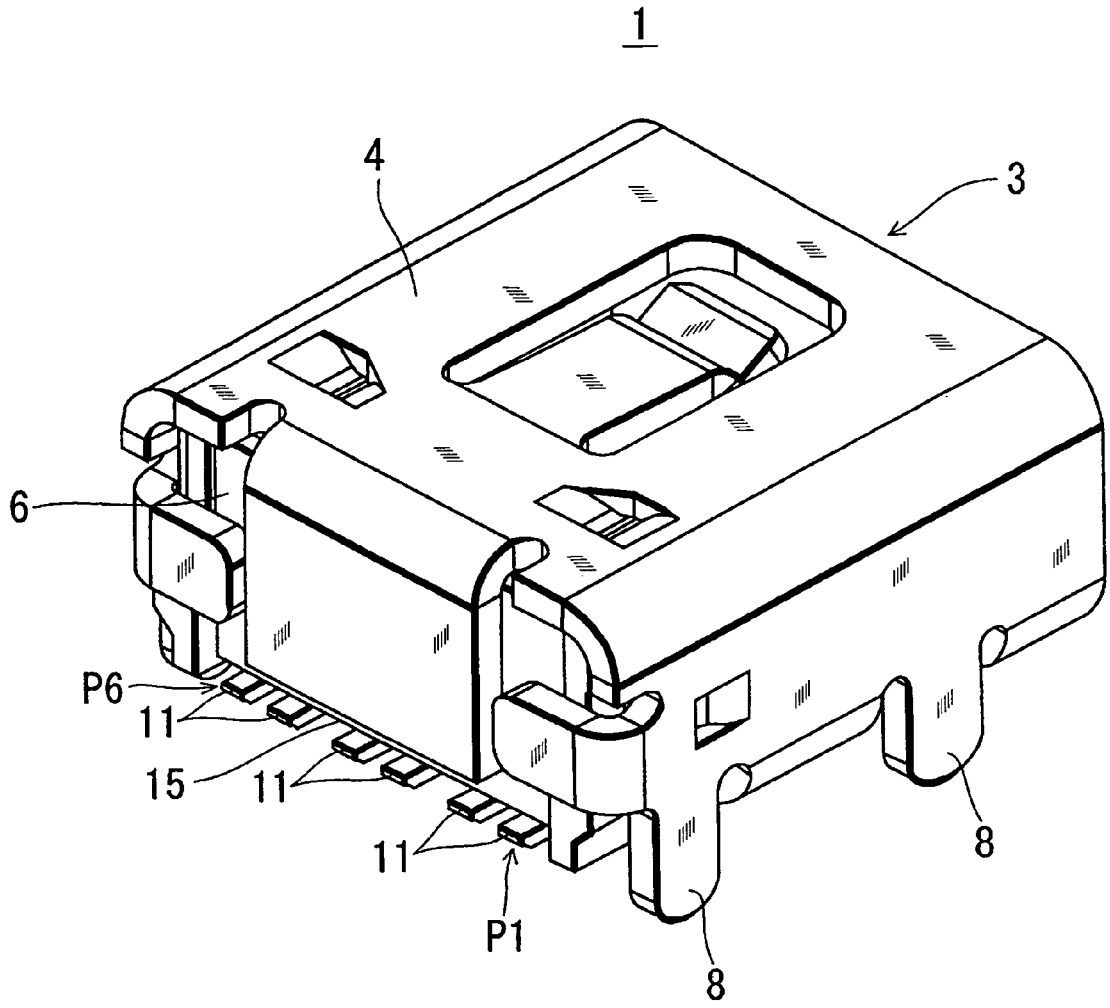
FIG. 2 is an external view of the multipolar connector of the embodiment of the invention, as seen from an obliquely rear side.
Figure 3:
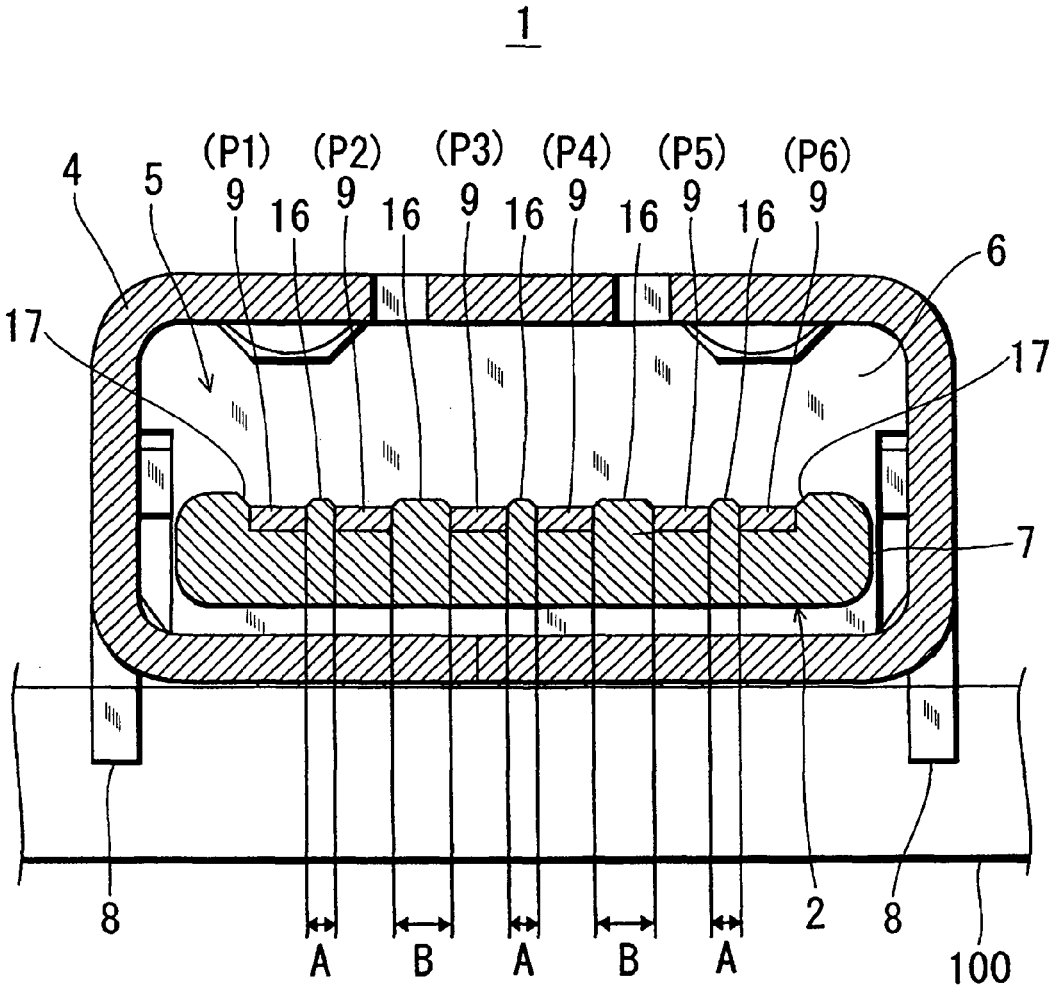
FIG. 3 is a sectional front view of the multipolar connector of the embodiment of the invention.
Figure 4:
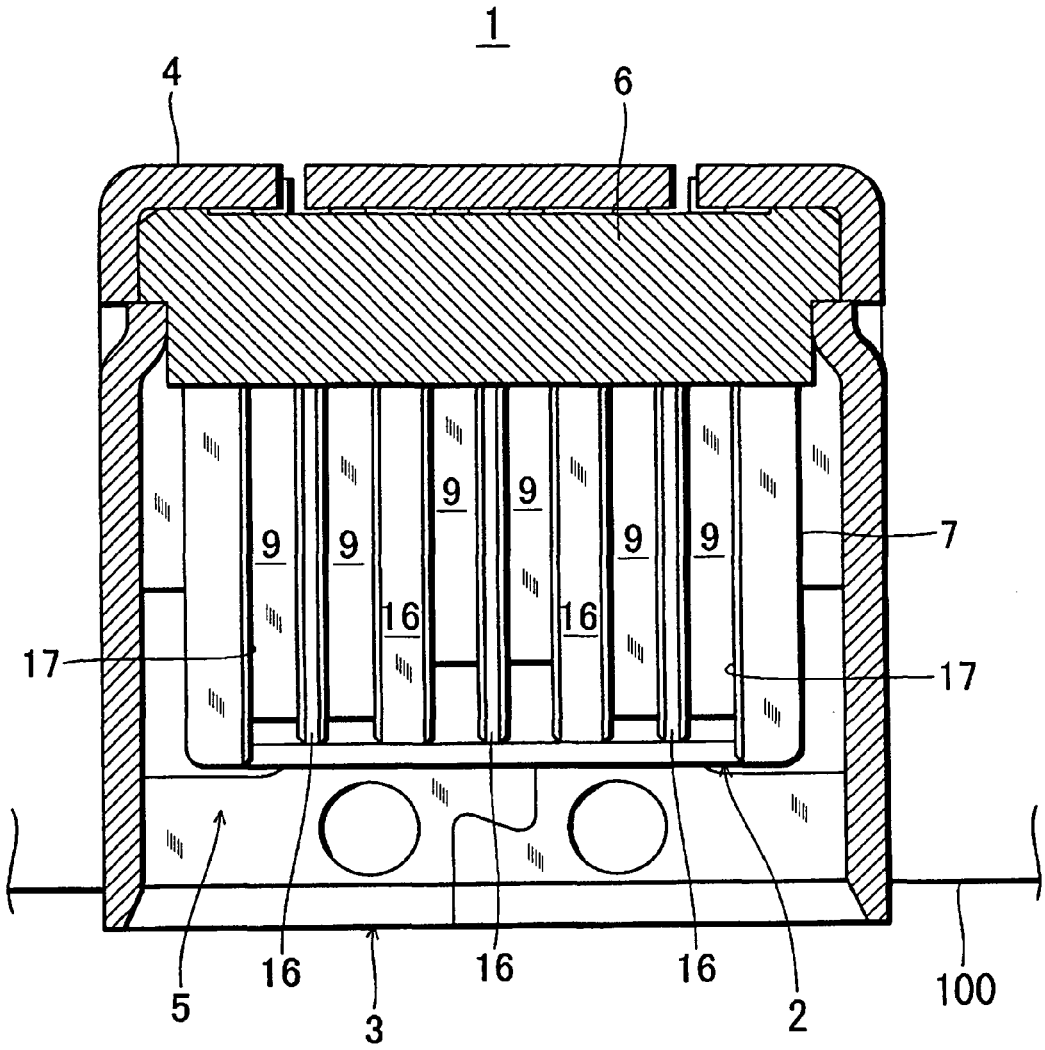
FIG. 4 is a sectional plan view of the multipolar connector of the embodiment of the invention.
Figure 5:
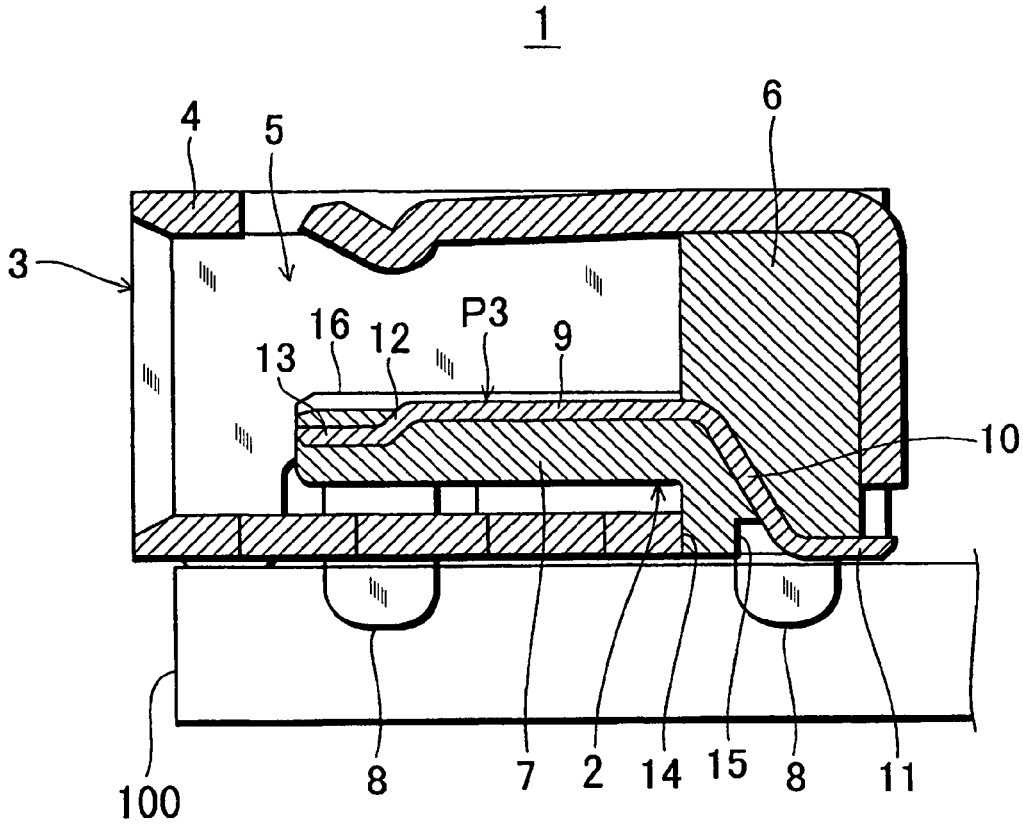
FIG. 5 is a sectional side view of the multipolar connector of the embodiment of the invention.

FIG. 1 is a external view of a multipolar connector of an embodiment of the invention, as seen from an obliquely front side, FIG. 2 is a external view of the connector as seen from an obliquely rear side, FIG. 3 is a sectional front view of the multipolar connector, FIG. 4 is a sectional plan view of the multipolar connector, and FIG. 5 is a sectional side view of the multipolar connector. In the following description, it is assumed that the directions of arrows a-b in FIG. 1 coincide with the front and rear directions (length direction) of the connector, the directions of arrows c-d coincide with the upper and lower directions (height direction) of the connector, and the directions of arrows e-f coincide with the left and right directions (width direction) of the connector.

The multipolar connector 1 shown in FIGS. 1 to 5 is a small and low-profile socket that is to be surface mounted on an edge of a printed circuit board (an example of a connection object) 100 on which strip lines are formed, and then mounted on a portable telephone. The counter connector for the multipolar connector 1 is a small and low-profile plug that is attached to an end of one cable through which the portable telephone is connected to another electronic apparatus such as a digital television receiver. The pair of the socket and the plug is used for viewing, for example, an HD video image taken by the portable telephone, on a large screen display.

The multipolar connector 1 has: a housing 2 which is formed by an insulating material such as a synthetic resin; a plurality of terminals (pins) P . . . which are integrated to be held and fixed with the housing 2 by insert molding; and a metal-made shield case 4 which covers the periphery of the housing 2 other than an opening 3.

The opening 3 is disposed in the front end side of the housing 2, and the counter connector is fitted through the opening 3. A hollow portion 5 is formed inside of the opening 3, and a fitting portion of the counter connector is inserted into the hollow portion 5.

The rear side (back side) of the hollow portion 5 is closed by a rectangular parallelepiped terminal support basal portion 6 which is fitted into a rear portion of the shield case 4. In the middle of the lower half of the hollow portion 5, a plate-like terminal supporting portion 7 is projected from the terminal support basal portion 6 toward the opening 3 on the front side. The terminal support basal portion 6 and the terminal supporting portion 7 are formed integrally with the housing 2. Four legs 8 are downward projected from the lower face of the shield case 4.

In the multipolar connector 1, the number of terminals is suppressed to a small number or six, thereby realizing a size which can be mounted on a portable telephone (an example of a small electronic apparatus).

Figure 6A:
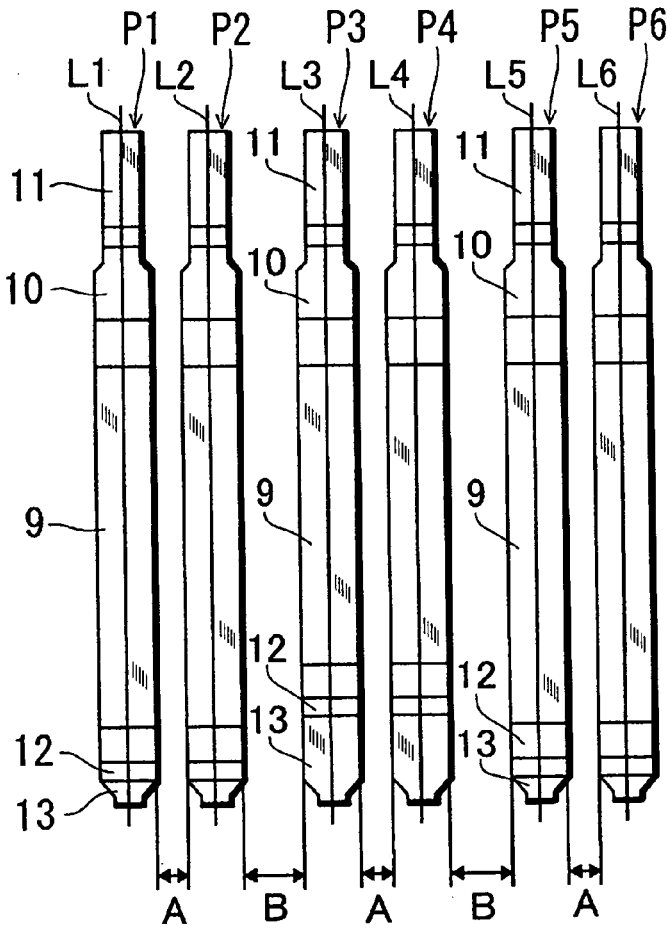
FIG. 6A is a plan view showing terminals of the multipolar connector of the embodiment of the invention.
Figure 6C:
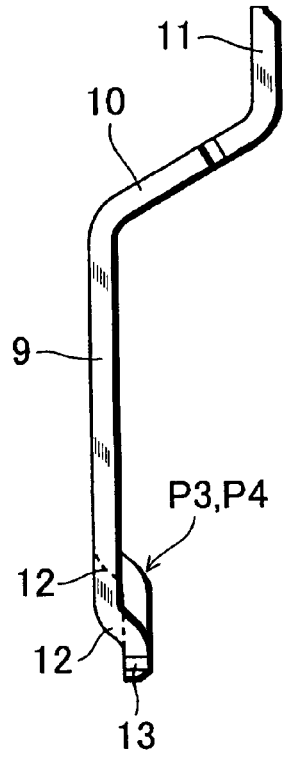
FIG. 6C is a side view.
Figure 6B:
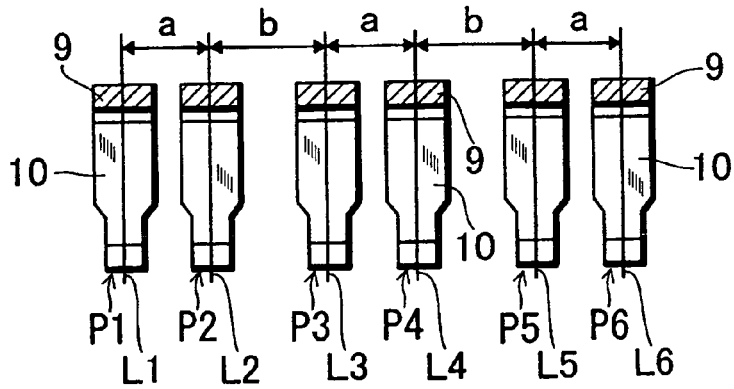
FIG. 6B is a sectional front view.

Next, the terminal configuration will be described with reference to also FIGS. 6A to 6C. FIG. 6A is a plan view showing terminals of the multipolar connector of the embodiment of the invention, FIG. 6B is a sectional front view, and FIG. 6C is a side view.

As shown in FIG. 6, six terminals P . . . are collectively formed by applying punching and bending processes on a metal plate (a hoop material) having a high electrical conductivity. Each of the six terminals P . . . includes: a contacting portion 9 which has a rectangular plat-like shape extending in the front and rear directions; a supporting portion 10 which is extended in an obliquely rearward and downward direction from a rear end portion of the contacting portion 9 while maintaining the width dimension; a terminal portion 11 which is extended rearward from an inclined lower end portion of the supporting portion 10 while evenly slightly reducing the width dimension from the both sides; a step portion 12 which is formed in the vicinity of a tip end part (front end part) of the contacting portion 9, and which is downward directed; and an embedded portion 13 which is configured by the tip end part of the contacting portion 9 that is extended from the step portion 12, and that is further lowered by one step. Each of the terminals is linearly (straightly) formed in a plan view over the whole length extending from the embedded portion 13 in the front end portion to the terminal portion 11 in the rear end portion, and has a center line L which is linearly extended in directions of inserting and extracting the counter connector.

The six terminals P . . . are collectively formed so as to respectively have strip-like shapes in which the rear ends are connected to a carrier, and which are laterally arranged in one row while forming predetermined gaps in the right and left directions. The terminals in the strip-like shapes are loaded in a molding machine to be subjected to insert molding, and then separated from the carrier to be attached as six individual terminals P . . . to the housing 2.

As shown in FIGS. 1 to 5, in the six terminals P . . . , the contacting portions 9 are extended from the respective supporting portions 10 toward the front side of the housing 2. In order to allow the terminal portions 11 to be extended from the supporting portions 10 toward the rear side of the housing 2, the terminals are attached in one row while forming predetermined gaps in the right and left directions of the housing 2 in a state where the length direction coincides with the front and rear directions of the housing 2. For the sake of convenience, the six terminals P . . . are sequentially denoted by P1, P2, P3, P4, P5, and P6 (P1 to P6) while advancing from the left end toward the right side as seen from the front side of the multipolar connector 1, and their center lines L are denoted by L1, L2, L3, L4, L5, and L6 (L1 to L6).

The terminals P1 to P6 will be described. In a state where the terminals are attached to the housing 2, the supporting portions 10 are embedded into a resin (a dielectric material) of the terminal support basal portion 6, and the contacting portions 9 are forward extended from the front face (the rear wall: the back wall of the hollow portion 5) of the terminal support basal portion 6 to the tip end (the front end) of the terminal supporting portion 7, on the upper surface of the terminal supporting portion 7, and laterally arranged in one row while forming predetermined gaps in the right and left directions, on the upper surface of the terminal supporting portion 7. A bottom portion of the terminal support basal portion 6 is fitted into an opening 14 which is disposed in a rear lower face of the shield case 4, and the lower face of the terminal support basal portion 6 is substantially flush with that of the shield case 4. A terminal portion housing recess 15 is formed in the lower face of the terminal support basal portion 6. In the terminal portion housing recess 15, the six terminal portions 11 are rearward extended to the rear end of the shield case 4, and laterally arranged in one row while forming predetermined gaps in the right and left directions.

In each of the terminals P1 to P6, in order to allow only the upper surface of the contacting portion 9 behind the step portion 12 to be exposed substantially flushly with the upper surface of the terminal supporting portion 7, the step portion 12, the embedded portion 13 in front of the step portion, and the thickness of the contacting portion 9 behind the step portion 12 are embedded into a resin (a dielectric material) of the terminal supporting portion 7. In the housing 2, partition walls 16 which are upward projected from the upper surfaces of the contacting portion 9 are disposed between the contacting portions 9 of the terminals P1 to P6. Side wall portions 17 which are upward projected from the upper surfaces of the contacting portions 9 similarly with the partition walls 16 are disposed in the both side portions of the upper surface of the terminal supporting portion 7. The terminal portions 11 are drown out from the bottom side of the rear end portion of the multipolar connector 1 through the opening 14 of the shield case 4 and the terminal portion housing recess 15 of the housing 2, and the lower surfaces of the terminal portions 11 are exposed substantially flushly with the lower face of the shield case 4 to be formed as surface mounting terminal portions 11.

When a fitting portion of the counter connector is inserted through the opening 3 of the multipolar connector 1 into the hollow portion 5 which is in the periphery of the terminal supporting portion 7, the shield case 4 of the multipolar connector 1 and a shield case of the counter connector are electrically connected to each other, and six counter terminals (movable terminals having a spring property) disposed in an upper portion of the interior of the fitting portion of the counter connector are contacted with and electrically connected to the upper surfaces of the contacting portions 9 behind the step portion 12 in the terminals P1 to P6 of the multipolar connector 1. The electrical connections are held by the fitting between the multipolar connector 1 and the counter connector.

When the multipolar connector 1 is surface mounted on the edge of the printed circuit board 100, the shield case 4 is electrically connected to an electromagnetic shield layer of the printed circuit board 100 through the legs 8, and the terminal portions 11 of the terminals P1 to P6 are overlaid on six land pads disposed on the printed circuit board 100, and then physically and electrically connected thereto by soldering, respectively.

In the terminals P1 to P6, the two middle adjacent terminals P3, P4 are high speed signal terminals, and constitute a terminal pair in which the terminals are paired for transmitting a pair of differential signals. The other four terminals P1, P2, P5, P6 are one ground terminal, one empty ground terminal, one low speed signal terminal, and one power source terminal, respectively, so that the following terminal arrangements are enabled: a terminal arrangement where the terminal pair P3, P4 is interposed between the power source terminal and the ground terminal, and signal separation and ground shield are enhanced; that where the terminal pair P3, P4 is interposed between the two ground terminals, and ground shield is further enhanced; and that where the terminal pair P3, P4 is interposed between the low speed signal terminal and the power source terminal or the ground terminal. The use, arrangement, and other configurations of the other four terminals P1, P2, P5, P6 are not restricted to the above.

A pair of differential signals (two signals which have the same level and opposite polarities) are supplied to the terminal pair P3, P4 through a differential signal line pair of the printed circuit board 100. In the other four terminals P1, P2, P5, P6, for example, a low speed signal is supplied to the low speed signal terminal through a signal line of the printed circuit board 100. The two ground terminals and the power source terminal are connected to ground and power source electrodes of the printed circuit board 100, respectively.

The terminal pair P3, P4 and the non-paired terminals P2, P5 which are adjacent to the pair are arranged so that a first gap A disposed between the terminals P3, P4 of the terminal pair P3, P4 is narrower than a second gap B disposed between the terminal pair P3, P4 and the non-paired terminals P2, P5 which are adjacent to the pair (A<B). In other words, the terminal pair P3, P4 and the non-paired terminals P2, P5 which are adjacent to the pair are arranged so that a first pitch gap a between the terminals P3, P4 of the terminal pair P3, P4 is shorter than a second pitch gap b between the terminal pair P3, P4 and the non-paired terminals which are adjacent to the pair (a<b).

In this way, the first gap A disposed between the terminals P3, P4 of the terminal pair P3, P4, and the second gap B disposed between the terminal pair P3, P4 and the non-paired terminals P2, P5 which are adjacent to the pair are made different from each other, and the terminal gap (the first gap A) in the terminal pair P3, P4 is narrowed, whereby the coupling force of the differential pair can be enhanced, and the terminal gap (the second gap B) between the terminal pair P3, P4 and the non-paired terminals P2, P5 which are adjacent to the pair is widened, whereby an influence of the non-paired terminals P2, P5 on the terminal pair P3, P4 can be reduced. As a result, a signal can be transmitted also in the connector portion in the differential mode.

In this case, in each of the terminals P1 to P6, the embedded portion 13 to be embedded into the housing 2 is disposed in the tip end part of the contacting portion 9 so that the tip end part is surrounded by the resin (dielectric material), and, in the housing 2, between the contacting portions 9 of the terminals P1 to P6, the partition walls 16 which are projected from the contacting faces of the contacting portions 9 are disposed. Therefore, the coupling force of the differential pair is further enhanced.

In the terminals P3, P4 of the terminal pair P3, P4, and the non-paired terminal P2 or P5, the respective center lines L2, L3, L4, L5 are linearly extended in the directions of inserting and extracting the counter connector in a plan view. Therefore, the uniformity of the terminal gap (the first gap A) in the terminal pair P3, P4 can be easily ensured, so that the impedance hardly becomes discontinuous, and the shapes of the terminals P1 to P6 are uniform. In the case where the housing 2 and the terminals P1 to P6 are to be integrated with one another by insert molding, therefore, molds can be easily produced, and a high accuracy can be easily obtained.

As a result, the multipolar connector 1 is obtained in which, in order to prevent the impedance from being discontinuous, and molds which are used for integrating the housing 2 made of an insulating material with the terminals P1 to P6 by insert molding, from being hardly produced and being lowered in accuracy, the coupling force between the differential pair can be enhanced and an influence of the non-paired terminal P2 or P5 can be reduced, and a signal can be transmitted also in the connector portion in the differential mode, and which has excellent high speed transmission characteristics.

Also with respect to, in the terminals P1 to P6, the two left adjacent terminals P1, P2 and the two right adjacent terminals P5, P6, the first gap A is disposed between the terminals P1, P2, and between the terminals P5, P6 to form the terminal pair P1, P2 and the terminal pair P5, P6, so that the terminals P1 to P6 configure the three terminal pairs P1, P2, P3, P4, and P5, P6, the gaps between the two adjacent terminal pairs P1, P2 and P3, P4, and P3, P4 and P5, P6 are set to the second gap B, and the terminals P1 to P6 are formed as pairs of two terminals.

In the configuration where the terminals P1 to P6 are formed as pairs of two terminals, even when a ground terminal is not disposed between the pairs, the pairs can cope with a high speed signal. Namely, all of the pairs can be used as a terminal pair for transmitting a high speed signal.

Although one high speed signal pair is used, the connector can cope with the case where two or three pairs are necessary. Furthermore, the terminals P1 to P6 are formed as pairs of two terminals, and hence the gaps between the pairs are widened. Even when further pairs are required, therefore, an additional high speed signal pair can be easily formed. Namely, the high speed signal pair may not be one, and even the case where the number of pairs is increased can be easily coped because the terminals are formed as pairs.

A structure of a printed circuit board where two or more signal lines and ground lines are juxtaposed on the same plane is called a coplanar waveguide. As apparent from FIG. 3, a structure similar to a coplanar waveguide of a printed circuit board is formed by the terminal pair P3, P4 which is juxtaposed on the same plane in the housing 2, the non-paired terminals P2, P5 which are adjacent to the pair, and the metal-made shield case 4 which covers the periphery of the housing 2.

When the coplanar structure is formed in the multipolar connector 1 as described above, a transmission line which is optimum for transmitting a high speed signal is obtained.

Although the embodiment of the invention has been described with exemplifying a socket type multipolar (six-pole) connector, the invention is not restricted to this, and may be implemented in various modified manners without departing the spirit of the invention. For example, the invention may be preferably implemented in a plug type multipolar connector, and a connector for transmitting high-speed differential signals, such as a socket and a plug of a multipolar connector for board-to-board or board-to-cable connection.

DESCRIPTION OF REFERENCE NUMERALS 1 multipolar connector
2 housing
4 shield case
9 contacting portion
10 supporting portion
11 terminal portion
13 embedded portion
16 partition wall
100 printed circuit board (connection object)
A first gap
a first pitch gap
B second gap
b second pitch gap
L1 to L6 center line
P1 to P6 terminal

What is claimed is:

1. A multipolar connector having a housing made of an insulating material, and a plurality of terminals which are held by said housing, wherein said plurality of terminals comprise:

two or more terminal pairs including a first terminal pair in which two terminals that are adjacent to each other are separated by a first gap A and are paired, said plurality of terminals further comprising one non-paired terminal which is adjacent to said first terminal pair and separated by a second gap B, wherein said first terminal pair is a pair for transmitting differential signals, said first gap A is narrower than said second gap B in each of said terminals of said first terminal pair and said non-paired terminal, and the gap between two adjacent terminal pairs is the second gap B;

a contacting portion adapted to be connected to a counter terminal;

a terminal portion adapted to be connected to a connection object; and a supporting portion through which said contacting portion and said terminal portion are coupled to each other are disposed, and, in said terminals of said first terminal pair, and said non-paired terminal, respective center lines are linearly extended in counter connector inserting and extracting directions in a plan view, and wherein a tip end part of said contacting portion is adapted to be connected to a counter contacting portion, said supporting portion and a terminal portion of a rear end portion are in parallel with each other over a whole length in a plan view.

2. A multipolar connector according to claim 1, wherein, in each of said plurality of terminals, an embedded portion which is embedded into said housing is disposed in said tip end part of said contacting portion while surrounding said tip end part with an insulating material.

3. A multipolar connector according to claim 1, wherein, in said housing, between said contacting portions of said plurality of terminals, partition walls which are projected from contacting faces of said contacting portions are disposed.

4. A multipolar connector according to claim 1, wherein said connector further has a metal-made shield case which surrounds a periphery of said housing, and said housing, said plurality of terminals, and said shield case form a coplanar structure.

5. A multipolar connector having a housing made of an insulating material, and a plurality of terminals which are held by said housing, wherein said plurality of terminals comprise:

two or more terminal pairs including a first terminal pair in which two terminals that are adjacent to each other are separated by a first gap A and are paired, said plurality of terminals further comprising one non-paired terminal which is adjacent to said first terminal pair and separated by a second gap B, wherein said first terminal pair is a pair for transmitting differential signals, said first gap A is narrower than said second gap B in each of said terminals of said first terminal pair and said non-paired terminal, and the gap between two adjacent terminal pairs is the second gap B;

a contacting portion adapted to be connected to a counter terminal;

a terminal portion adapted to be connected to a connection object; and a supporting portion through which said contacting portion and said terminal portion are coupled to each other are disposed, and, in said terminals of said terminal pair, and said non-paired terminal, respective center lines are linearly extended in counter connector inserting and extracting directions in a plan view, and wherein a front end part of said contacting portion is adapted to be connected to a counter contacting portion and said supporting portion and each of said terminals is linearly formed in a plan view over the whole length extending from an embedded portion in said front end portion to the terminal portion in a rear end portion.

6. A multipolar connector having a housing made of an insulating material, and a plurality of terminals which are held by said housing, wherein said plurality of terminals comprise:

a first terminal pair in which two terminals that are adjacent to each other are separated by a first gap A and are paired and one non-paired terminal which is adjacent to said first terminal pair and separated by a second gap B, wherein said first terminal pair is a pair for transmitting differential signals and said first gap A is narrower than said second gap B in each of said terminals of said first terminal pair and said non-paired terminal;

a contacting portion adapted to be connected to a counter terminal;

a terminal portion adapted to be connected to a connection object; and a supporting portion through which said contacting portion and said terminal portion are coupled to each other are disposed, and, in said terminals of said first terminal pair, and said non-paired terminal, respective center lines are linearly extended in counter connector inserting and extracting directions in a plan view, and wherein a front end part of said contacting portion is adapted to be connected to a counter contacting portion and said supporting portion and each of said terminals is linearly formed in a plan view over the whole length extending from an embedded portion in said front end portion to the terminal portion in a rear end portion.

* * * * *